US005111494A

United States Patent [19]

Turner et al.

[11] Patent Number: 5,111,494

[45] Date of Patent: May 5, 1992

[54] MAGNET FOR USE IN A DRIFT TUBE OF AN X-RAY TUBE

[75] Inventors: Loyce A. Turner, SE. Smyrna; Phillip K. Ausburn, Lawrenceville, both of Ga.

[73] Assignee: North American Philips Corporation, New York, N.Y.

[21] Appl. No.: 574,623

[22] Filed: Aug. 28, 1990

[51] Int. Cl.[5] ..... H01J 35/30

[52] U.S. Cl. ..... 378/138; 378/137

[58] Field of Search ..... 378/138, 137, 121; 335/281, 250, 210; 250/396 ML

[56] References Cited

U.S. PATENT DOCUMENTS 3,243,667 3/1966 Enge ..... 335/210

4,899,354 2/1990 Reinhold ..... 378/137

FOREIGN PATENT DOCUMENTS 898637 7/1944 Fed. Rep. of Germany .

*Primary Examiner*—Janice A. Howell

*Assistant Examiner*—Don Wong

*Attorney, Agent, or Firm*—Anne E. Barschall

[57] ABSTRACT

An improved magnetic core for focussing electrons leaving the accelerating anode of an X-ray tube has rounded poles. Non-magnetic sealing material is placed between the poles and the magnetic core is sealed to the accelerating anode and to the target asesmbly, so that no separate drift tube is needed.

9 Claims, 2 Drawing Sheets

MAGNET FOR USE IN A DRIFT TUBE OF AN X-RAY TUBE

BACKGROUND OF THE INVENTION

1. Field of the Invention

The present invention relates to an improvement in the field of magnets for use with the drift tube of an x-ray tube.

2. Related Art

FIG. 1 is a cross-section of relevant interior portions of a conventional x-ray tube. Electrons boil off a cathode 101, are accelerated by an accelerating anode 102, pass through a drift tube 103, and hit a target anode 107. The target anode 107 then produces x-rays 108. A magnetic field 106 is produced in the drift tube 103 at the poles 108 of a magnetic core 105 and windings 104. The poles are sharply angled. The magnetic field 106 focuses the electrons passing through the drift tube. The drift tube 103 maintains a vacuum while the electrons pass through it.

Improvements in the magnetic core are needed to improve focus and field strength.

SUMMARY OF THE INVENTION

An object of the invention is to improve the magnetic core 105.

DETAILED DESCRIPTION OF THE PREFERRED EMBODIMENTS

Figure 1:
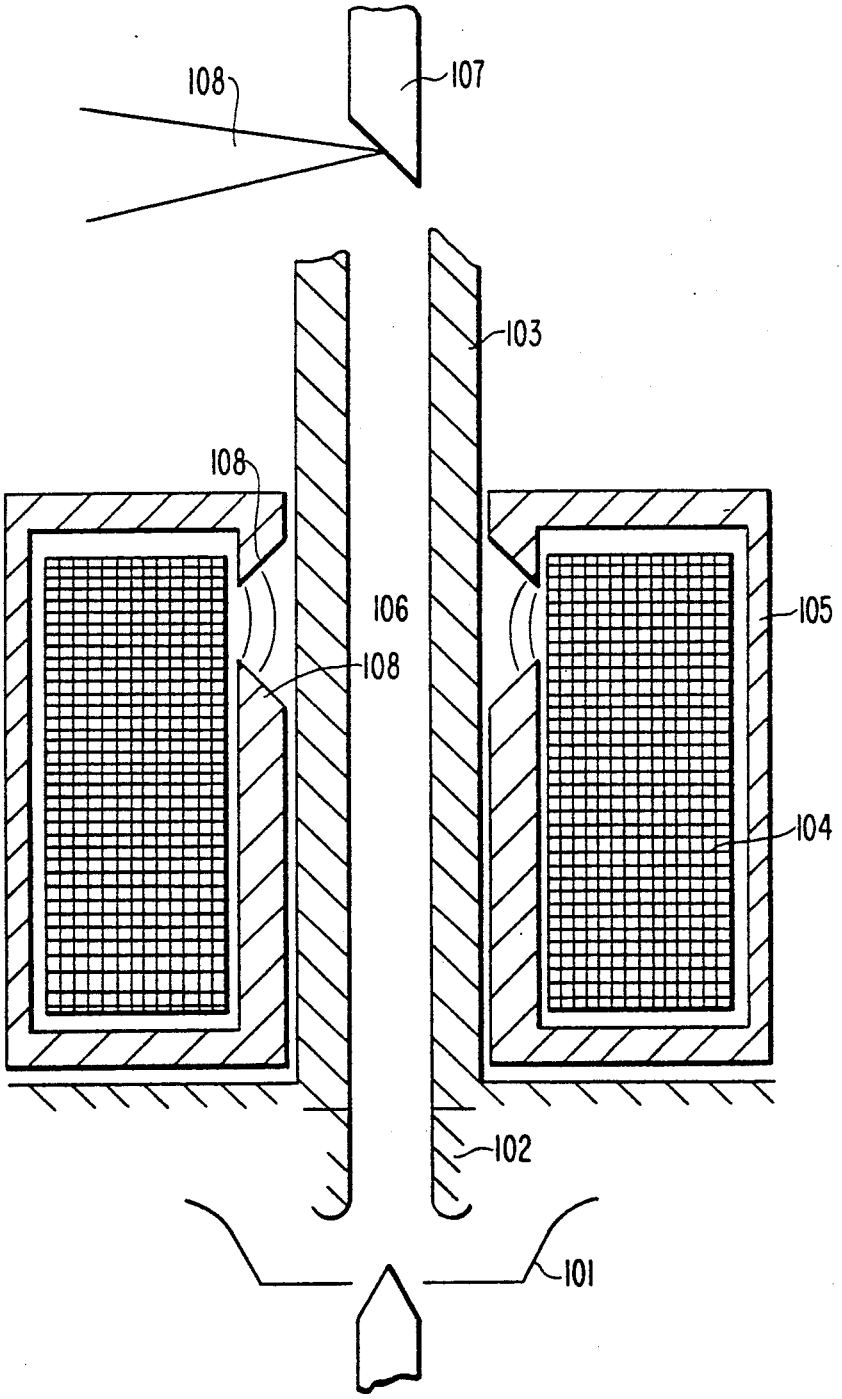
FIG. 1 PRIOR ART
FIG. 1 is a cross-section of relevant interior portions of a conventional x-ray tube.
Figure 2:
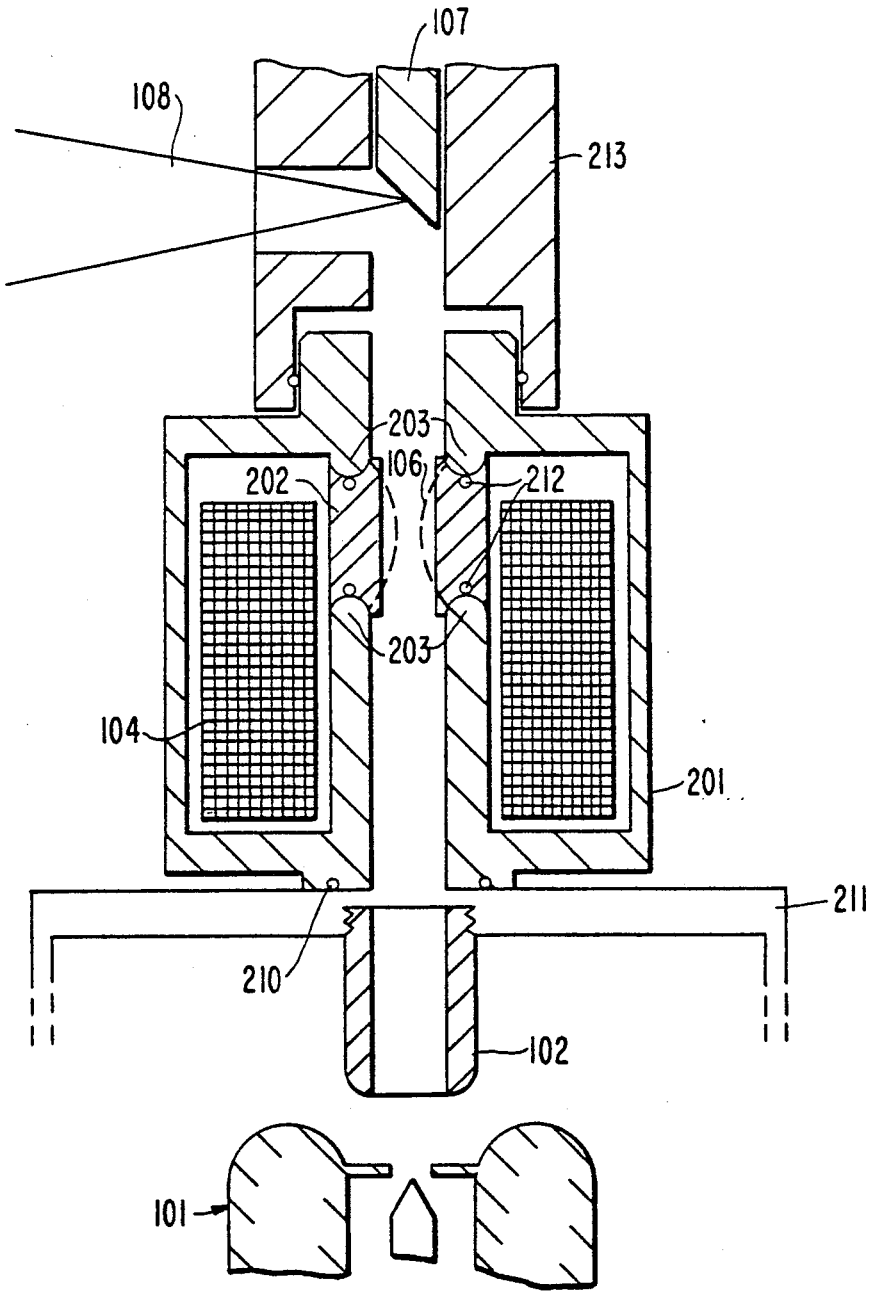
FIG. 2 is a cross-section of relevant interior portions of an x-ray tube using an improved magnetic core.

In FIG. 2, a solenoid magnetic core 201 according to the invention is shown in cross-section. The core has rounded poles 203, at which the magnetic field 106 is produced. The rounded poles are preferably semi-circular cross section.

In the prior art, it was believed that sharply angled poles would produce a stronger magnetic field because of the effects produced by the corners. However, experiments have shown that the corners in the sharply angled poles saturate at a low magnetic field. The rounded poles have proven therefore to have give a stronger magnetic field.

The core 201 is sealed with O-rings 210 to the tube shell 211 which is sealed to the accelerating anode 102 and the target anode 107. Non-magnetic material 202 such as aluminum is sealed with O-rings 212 to the poles 203. The target assembly 213 is sealed to the magnetic core 201 with O-rings 214. Consequently, the core 201 itself serves as a drift tube and eliminates the need for a separate drift tube 103. It has been found experimentally that using the core in this way, instead of a separate drift tube, requires less current to be used in the windings 104 and allows a smaller, more efficient focus, magnet, though alignment of the electron beam and magnet assembly is more critical, due to the smaller dimension.

We claim:

1. An x-ray tube comprising:

a) a cathode;

b) an accelerating anode for accelerating electrons from the cathode;

c) a magnet for focussing electrons leaving the accelerating anode, the magnet including a cylindrical magnetic core; and d) a target assembly;

wherein the improvement comprises:

e) non-magnetic material sealed between poles of the core;

f) a direct seal between the core and the accelerating anode; and g) a direct seal between the core and the target assembly; whereby a vacuum is maintained in the magnet along only the electron path without need of a separate drift tube.

2. The x-ray tube of claim 1 wherein the magnetic core has a toroidal exterior about an axis, the core defining a) an internal opening for containing a coil which is coaxial with the core; and b) a magnetic gap, communicating between the internal opening and the exterior, in a side of the core adjacent the axis, portions of the core adjacent the gap being for forming poles of the magnet.

3. The x-ray tube of claim 2 wherein the portions are rounded.

4. The x-ray tube of claim 3 wherein the portions have semi-circular cross section.

5. A magnetic core for use in a magnet which focuses electrons along an axis of an x-ray tube, the core having a toroidal exterior about the axis, the core defining a) an internal opening for containing a coil which is coaxial with the core; and b) a magnetic gap, communicating between the internal opening and the exterior, in a side of the core adjacent the axis, portions of the core adjacent the gap being for forming poles of the magnet; wherein the portions are rounded.

6. The core of claim 5 wherein the portions have semi-circular cross-section.

7. The core of claim 5 wherein a cross-section of the core containing the axis comprises first and second substantially rectangular members disposed on either side of the axis.

8. A magnet comprising the core of claim 5 and a coaxial coil within the core.

9. An x-ray tube comprising the magnet of claim 8.

* * * * *